US007916020B2

(12) United States Patent
Seidel

(10) Patent No.: US 7,916,020 B2
(45) Date of Patent: Mar. 29, 2011

(54) AUDIBLE ANTI-THEFT TAG

(76) Inventor: Stuart T. Seidel, Boca Raton, FL (US)

( * ) Notice: Subject to any disclaimer, the term of this patent is extended or adjusted under 35 U.S.C. 154(b) by 297 days.

(21) Appl. No.: 12/137,503

(22) Filed: Jun. 11, 2008

(65) Prior Publication Data

US 2008/0303670 A1 Dec. 11, 2008

Related U.S. Application Data

(60) Provisional application No. 60/943,288, filed on Jun. 11, 2007, provisional application No. 61/042,726, filed on Apr. 5, 2008.

(51) Int. Cl.
*G08B 13/14* (2006.01)

(52) U.S. Cl. ..... 340/568.1; 340/568.4; 340/571

(58) Field of Classification Search ..... 340/568.1, 340/568.2, 568.4, 571, 572.1, 572.4, 572.8, 340/539.11; 70/57.1, 282; 24/704.1, 704.2, 24/706.8

See application file for complete search history.

(56) References Cited

U.S. PATENT DOCUMENTS

| | | | | |
|---|---|---|---|---|
| 5,844,484 | A * | 12/1998 | Fujiuchi et al. | 340/572.1 |
| 5,995,003 | A * | 11/1999 | Rogers | 340/568.4 |
| 7,064,667 | B2 * | 6/2006 | Sosna | 340/568.7 |
| 7,168,275 | B2 * | 1/2007 | Fawcett et al. | 70/57 |
| 7,369,052 | B2 * | 5/2008 | Holmgren | 340/572.9 |
| 7,671,741 | B2 * | 3/2010 | Lax et al. | 340/572.1 |
| 2008/0247105 | A1 * | 10/2008 | Divan | 361/56 |

* cited by examiner

*Primary Examiner* — Van T. Trieu
(74) *Attorney, Agent, or Firm* — John C. Smith

(57) ABSTRACT

An audible anti-theft tag that has a multiple ways to activate an audible alarm under predetermined conditions. When the pin assembly is forcibly detached from an EAS tag, a high decibel alarm is automatically activated. The audible alarm in the anti-theft tag uses a thyristor control circuit which does not use power while the anti-theft tag alarm is inactive. Once activated, the alarm cannot be turned off. An optional multi-wire lanyard is available which is not susceptible to defeat by a shunt, and also activates the audible alarm when severed.

18 Claims, 9 Drawing Sheets

18

C1
R1
K1
R2
Buzzer
LED
Coil
6V
R3
D1
Thyristor
R4
GND

AUDIBLE ANTI-THEFT TAG

CROSS-REFERENCE TO RELATED APPLICATIONS

This non-provisional patent application is related to, and claims the benefit of, currently pending Provisional Patent Application Ser. No. 60/943,288, titled "Audible Anti-Theft Tag," filed Jun. 11, 2007, and naming Stuart T. Seidel, the named inventor herein, as sole inventor, and currently pending Provisional Patent Application Ser. No. 61/042,726, titled "Audible Anti-Theft Tag," filed Apr. 5, 2008, and naming Stuart T. Seidel, the named inventor herein, as sole inventor, and is hereby incorporated herein in its entirety.

BACKGROUND OF THE INVENTION

1. Technical Field

The present invention relates to anti-theft devices which attach to commodities for preventing theft of the commodity. In particular, it relates to a method and apparatus for using an audible anti-theft tag with multiple audio levels to alert merchants to removal of goods, which uses a unique power system to extend the operational life of the audible alarm, and which uses a unique shunt-proof multi-lead lanyard to detect when the lanyard is severed.

2. Background

Theft of all kinds has been an ongoing problem for virtually all retail establishments. One kind of theft, shoplifting, has caused substantial losses for retailers due to its widespread use. In an attempt to address this problem, a variety of devices have been developed to limit shoplifting losses by automatically alerting the retailer when an item of merchandise is being illegally removed from the premises.

One type of anti-theft device is the anti-theft tag (an "EAS" tag). An anti-theft tag is typically a small device which is secured to an inventory item with a securing pin. EAS tags are attached to goods prior to sale. When a customer purchases the goods, the salesman uses a detacher device to remove the EAS tag from the goods by disconnecting the securing pin from the EAS tag.

In the event a shoplifter attempts to leave the merchant's premises with goods, the goods will pass by detector devices at the store exit. When the detector senses a tag being removed from the store, it alerts the retailer via an alarm that is controlled by the detector.

Anti-theft tags of this type typically contain an EAS tag which holds a tuned circuit or antenna and associated circuitry, along with mechanical methods of securing the EAS tag to a securing means. The securing means would typically be a pin assembly that is a cap-like structure with a securing pin. The securing pin is pushed through an item, such as a garment, and then secured to the EAS tag. Once a customer has made a purchase, the employee would remove the anti-theft tag so that the customer can take the item out of the store without setting off an alarm. A problem associated with this type of anti-theft tag is that once the stolen goods with the anti-theft device are removed from the merchant's premises, the merchant may not be able to determine where the goods have gone. It would be desirable to structure an anti-theft tag such that stolen goods can be detected even after they are out of range of the anti-theft tag detectors.

Another problem associated with anti-theft tags is that it is possible to remove them prior to taking the goods past the detectors. It would be desirable to provide retailers with an anti-theft tag that will alert a merchant when the tag is removed from goods in an unauthorized manner without requiring the tag to be moved past the anti-theft tag detector at the store exit.

One attempt to address problems related to removal of tags and tracking goods after they have left the merchant's premises has been the development of anti-theft tags that have audible alarms. Unfortunately, these tags may also be limited in effectiveness due to the limited life span of internal batteries. Reductions in battery lifespan are caused by the power drain created by the audible alarm and by other internal circuitry. It would be desirable to have a method of improving the reliability of audible anti-theft tags by reducing battery drain, and thereby improving the effective useful life span of the internal batteries.

Another drawback to conventional audible anti-theft tags is that, due to the aforementioned battery problems, they may not be able to produce a sufficiently loud alarm when the anti-theft tag is detected passing an anti-theft detector, or when the EAS tag is forcibly removed from the pin assembly.

Yet another problem associated with conventional EAS tags is created by the need to use these tags in combination with large or irregular shaped items which cannot be secured via a securing pin. The use of a lanyard (i.e., a lead which extends in a loop from the EAS tag and around a package) allows large or irregular shaped packages to be secured to the EAS tag. In the prior art, the lanyards have sometimes been equipped with an internal electrical lead. The purpose of this lead is to provide a signal path that indicates to the EAS tag at the lanyard has not been severed. Unfortunately, thieves have discovered that by shunting the lead, the lanyard can be severed without alerting the EAS tag. It would be desirable to have a method of activating the EAS tag and/or its audible alarm even if a thief had shunted the lanyard.

While the prior art has provided numerous types of anti-theft tags, it has failed to provide an audible anti-theft tag that is difficult to defeat, which has multiple methods of activating the alarm by notifying merchants both when the anti-tag is removed or when the anti-theft tag is moved past an anti-theft tag detector, which has sufficient battery life to continue to produce an audible alarm for a substantial period of time, and which has an optional lanyard which will trigger the audible alarm and/or EAS tag even if the lanyard has been shunted.

SUMMARY OF INVENTION

The present invention solves the foregoing problems by providing an audible anti-theft tag that has a multiple ways to activate alarms. The securing pin assembly that attaches to the EAS tag has an audible alarm that is activated under predetermined conditions. First, when the pin assembly containing the audible alarm is forcibly detached from the EAS tag, a high decibel alarm is automatically activated. Second, if the anti-theft tag passes a tag detector, the detector will activate an alarm in the usual manner. Third, if the anti-theft tag passes a tag detector, the audible alarm in the anti-theft tag will also activate. Fourth, the alarm uses a thyristor control circuit which does not use power while the anti-theft tag alarm is inactive. As a result of the elimination of power drain, the battery lifespan is extended and there is more power available when the alarm is activated. Fifth, the EAS tag uses an independent multi-lead lanyard as a secondary method of activating the alarm. The alarm will be activated even if other activation means have been defeated, and even if the thief has shunted the lanyard lead.

The lanyard is a closed loop that allows the anti-theft tag to be attached to irregular shaped items such as purses, luggage, coats, etc. The lanyard uses a multi-lead internal signal line which triggers the alarm when severed, even if a thief uses a shunt in an attempt to defeat the lanyard.

DETAILED DESCRIPTION

Figure 1:
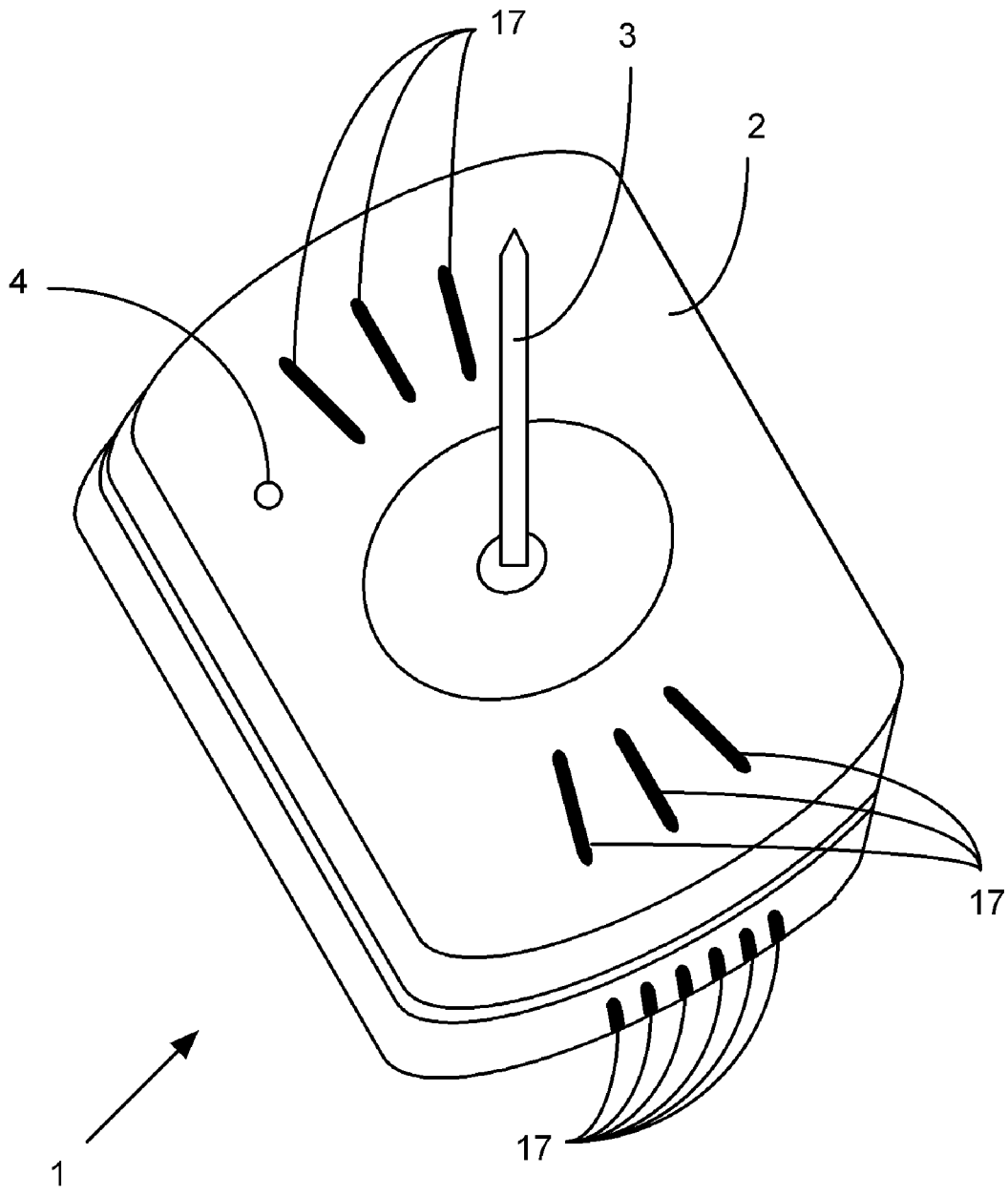
FIG. 1 is a perspective view of the lower side of an audible alarm assembly with the securing pin.

Prior to a detailed discussion of the figures, a general overview of the invention will be presented. The goal of the invention is to provide an anti-theft tag system that has audible alarms that are activated under a number of predetermined situations, that has enhanced power management to extend battery life and to provide the maximum amount of power for extended activation of the alarm, and has a lanyard which triggers when severed even if the lanyard is shunted by a thief. The anti-theft tag includes a pin assembly with an integral audible alarm. When the anti-theft tag is moved past a detector at the entrance of a store, multiple alarm mechanisms are activated. First, the detector activates its internal audible alarm. The second audible alarm is in the pin assembly of the anti-theft tag. When it detects that it is moving past a detector, it also activates its internal alarm. Third, the anti-theft tag may have an optional lanyard to facilitate its use with large or irregular shaped goods.

The use of two alarms in this manner provides additional advantages to the retailer. First, the audible alarm in the detector alerts the store employees to a possible theft. This allows them to respond immediately. Second, the use of a separate, independent, alarm provides a second theft deterrent. For example, if a thief gets past the detector alarm, he may disappear without being caught. However, the audible alarm in the pin assembly is designed such that, once activated, it remains on until the battery power runs out or until it is reset. Further, the alarm in the pin assembly preferably outputs audio at a high decibel level. In the preferred embodiment, the decibel level is approximately 70 decibel, but those skilled in the art will recognize that this can vary. The use of the second alarm makes it difficult for the thief to escape with the goods because it continues to attract attention wherever the thief takes the goods.

Another feature provided by the invention is the pin assembly can detect when it is forcibly removed from the EAS tag. This activates the alarm even though the anti-theft tag may be in the store, and away from the detector. As a result, the store personnel are alerted when the thief attempts to remove the anti-theft tag so that the goods can be safely taken from the store.

The anti-theft tag operates with minimum power by using a thyristor based control circuit. Prior art tags use other power technologies that rely on circuits that are continuously active. As a result, there is a continuous drain on their batteries. The thyristor circuit used by the invention uses very little current until activated. As a result, there is more available power to run the alarm for a longer time period when a theft is detected. Further, the batteries last longer during periods of inactivity.

The invention also provides an additional method of triggering an audible alarm and/or the EAS tag when an optional feature such as a lanyard is used to facilitate the use of an EAS tag with large goods, or goods having an irregular shape. The novel lanyard provided by this invention provides a lanyard with a signal lead that extends from a first end of the lanyard, substantially through the length of the lanyard, and then returns through the lanyard to the first end of the lanyard. By returning the lead to a second connection at its starting point, the lanyard will actually have a closed loop for the length of the lanyard. In the event a thief attempts to defeat the lanyard by placing a shunt from one end of the lanyard to the other, the alarm will still be activated when the lanyard is severed.

Having discussed the invention in general, we turn now to a detailed discussion of the figures.

FIG. 1 is a perspective view of the lower side of audible alarm assembly 1 with the securing pin 3 attached to the audible alarm 2. In use, pin 3 is pushed through a garment and inserted into an EAS tag 5 (illustrated below in FIG. 3). Also shown in this figure is reset aperture 4. In the event the alarm is activated, a store employee can insert a pin (or, alternatively, a specially shaped device such as a key) to deactivate the alarm. Preferably, when pin 3 is secured to an EAS tag 5, the reset aperture 4 is concealed by EAS tag 5. Also shown in this figure are apertures 17 which will allow the audible alarm to be more easily heard.

When EAS tag 5 is moved past a detector, the internal alarm in the detector is activated in the normal manner. In addition, the audible alarm 2 is also triggered. The trigger circuit in the audible alarm 2 uses a thyristor (a silicon controlled rectifier) to control activation of the alarm. Thyristor circuits are well known in the art. The thyristor provides an advantage in that when it is used to turn on the alarm, it cannot be turned off until power is removed from the circuit.

In the case where the audible alarm 2 is activated and it is to be reset, the sales personnel will first use a detaching device to remove the audible alarm assembly 1 from the EAS tag 5. Once removed, the sales personnel will insert a reset pin or key (not shown) into reset aperture 4. When inserted, the reset pin will open the power line and reset the circuit.

In the case where the audible alarm 2 is activated by moving it past a detector, the reset aperture 4 is concealed. This prevents the thief from resetting the alarm.

Figure 2:
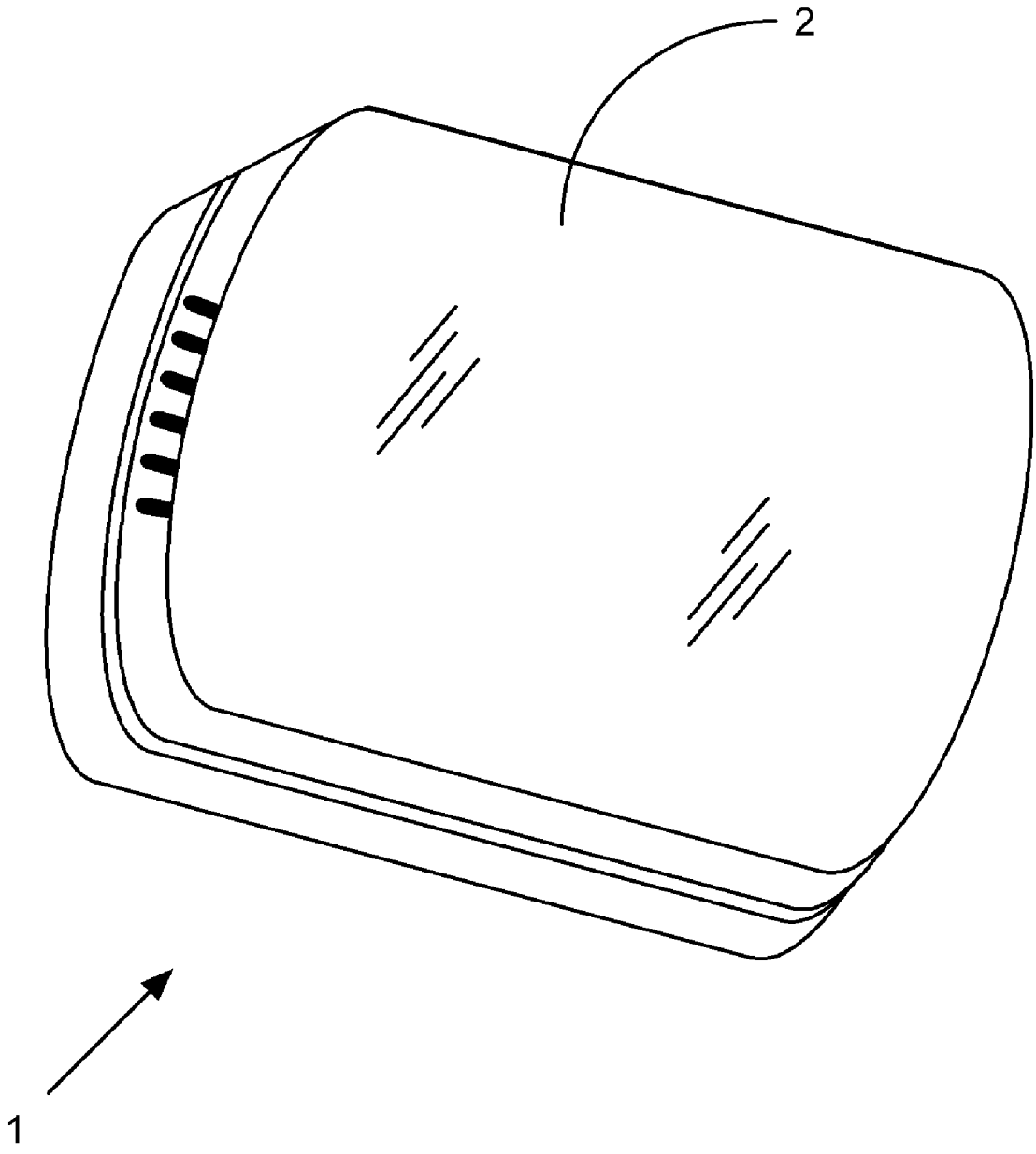
FIG. 2 is a perspective view of the upper side of an audible alarm assembly.

FIG. 2 is a perspective view of the upper side of audible alarm 2. Those skilled in the art will recognize that the shape and size of audible alarm 2 can vary to suit individual design choices. The only requirement is that the design should be such that it discourages unauthorized tampering.

Figure 3:
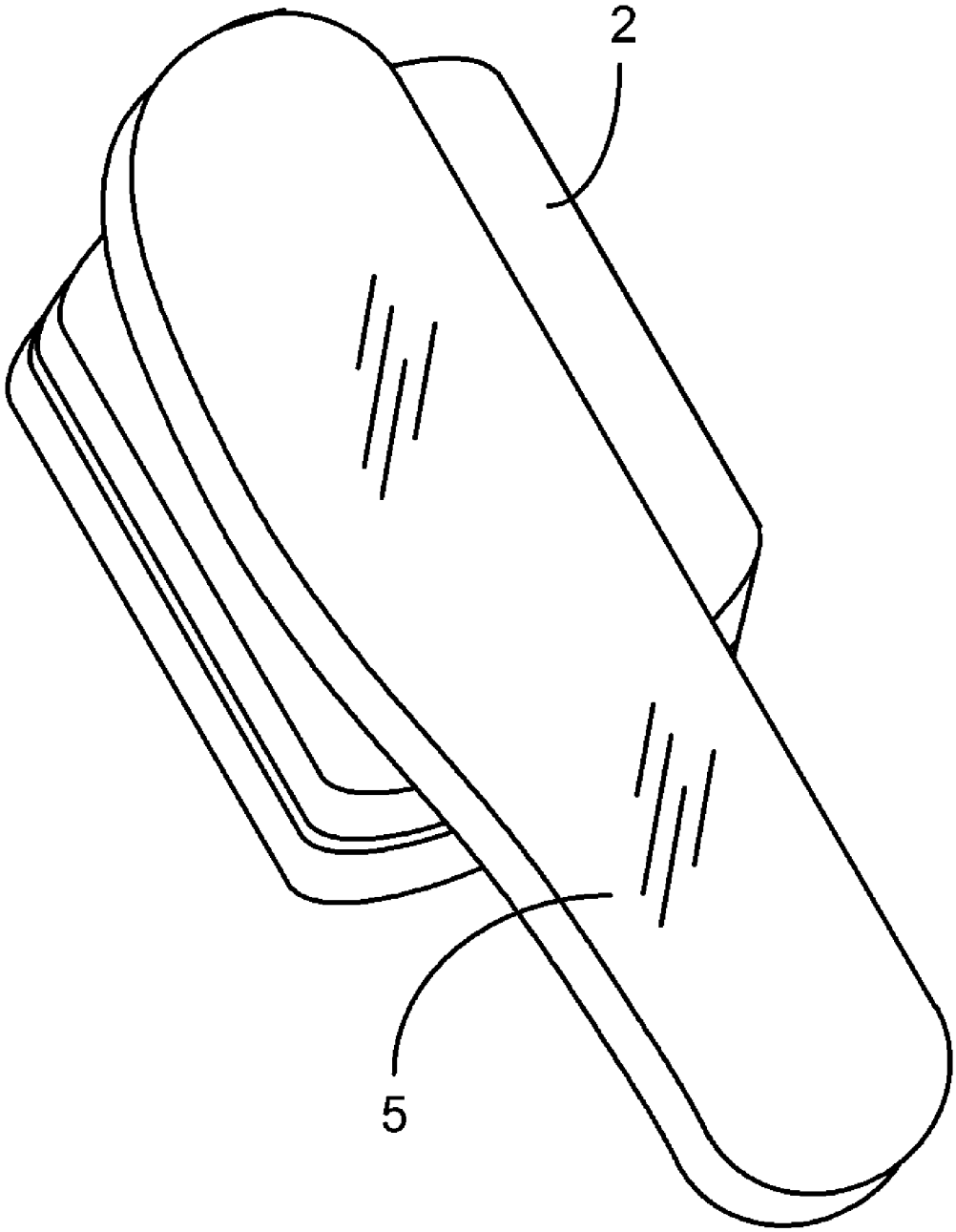
FIG. 3 is perspective view of an anti-theft tag showing the audible alarm assembly secured to an EAS tag.

FIG. 3 is perspective view of an anti-theft tag showing the audible alarm 2 secured to an EAS tag 5. As can be seen in this figure, reset aperture 4 is concealed by the EAS tag 5.

Figure 4:
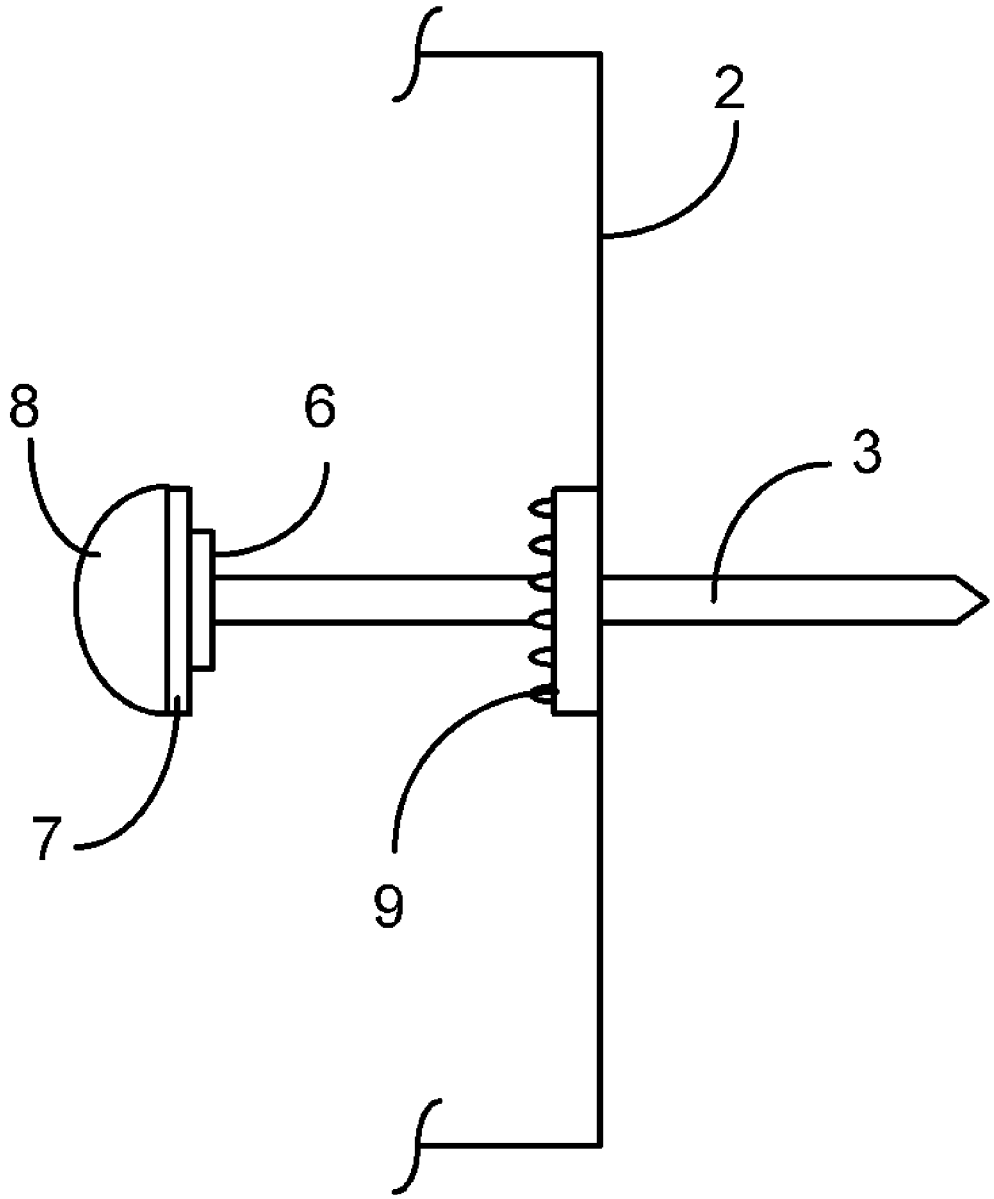
FIG. 4 is cutaway side view of an anti-theft tag showing the alarm trigger used by the audible alarm assembly to detect when the audible alarm assembly is forcibly removed from the EAS tag.

FIG. 4 is cutaway side view of an anti-theft tag showing a novel alarm trigger used by the pin 3 to detect when the pin 3 is forcibly removed from the EAS tag 5. As can be seen, pin 3 extends through the wall of audible alarm 2. It is attached to insulator layer 6, contact plate 7, and cap 8. Also shown are contact pads 9. During normal use, insulator layer 6 prevents contact plate 7 from coming in contact with contact pads 9. The contact pads 9 are contact points that, when electrically connected by contact plate 7, will apply voltage to the thyristor. When this happens, the thyristor turns on and the alarm is activated. When a thief attempts to forcibly detach the audible alarm assembly 1 from the EAS tag 5, the pressure applied to pin 3 pulls cap 8 and contact plate 7 toward the contact pads 9. Eventually, the contact plate 7 will be forced into contact with contact pads 9, the power circuit will be complete, and the audible alarm 2 will be activated.

For ease of discussion, the audible alarm and the alarm trigger were discussed as being part of the audible alarm 2. Those skilled in the art will recognize that the invention can also be implemented with the audible alarm and the alarm trigger in the EAS tag 5. In this case, the contact pads, contact plate, and insulator layer would be located inside the EAS tag and incorporated into the conventional locking mechanism that grasps the securing pin 3.

Figure 5:
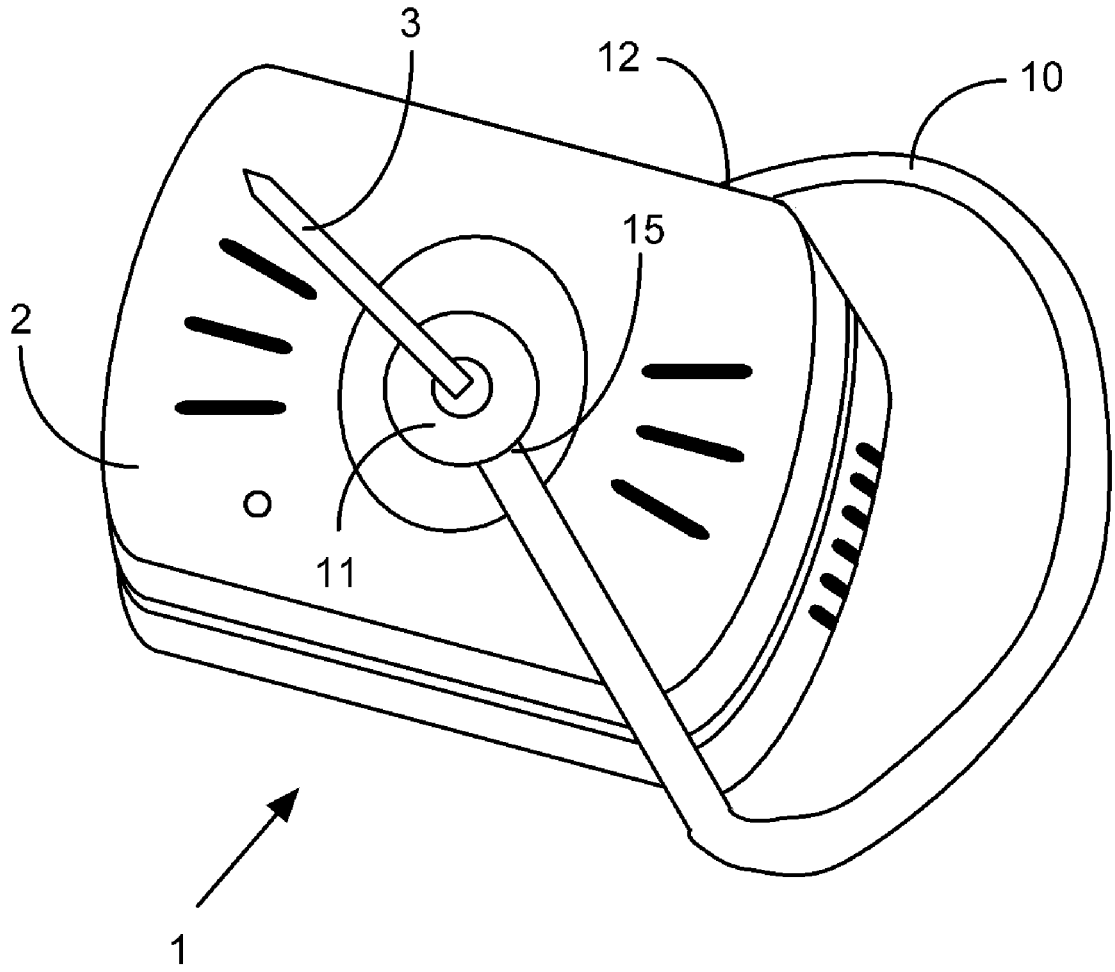
FIG. 5 is perspective view of an anti-theft tag showing the lanyard extending from the body of the audible alarm to the pin.

FIG. 5 illustrates an alternative preferred embodiment in which a lanyard 10 is added as an additional element. In this embodiment, the proximal end 12 of lanyard 10 is secured to the audible alarm 2, and the distal end 15 has a washer 11 that is secured to pin 3 during use. When the EAS tag 5 and audible alarm assembly 1 are secured to an item, the lanyard 10 forms a loop that is attached to odd shaped objects, such as purses, luggage, garments, bicycles, cameras, or any other item which allows a closed loop to be securely attached loop can be as long as necessary to attach to a particular object.

In the prior art, the lanyards 10 often use a single signal lead extending from proximal end 12 to washer 11. The signal lead is part of an electrical circuit. In the event the thief attempted to steal an item by severing the lanyard 10, the circuit would be broken and the alarm would be triggered. Unfortunately, thieves have discovered that by placing a shunt between proximal end 12 and washer 11, the electrical circuit can be maintained even if lanyard 10 is severed. As discussed more fully in regard to FIG. 6, below, the invention overcomes this problem by eliminating the ability to defeat the electrical circuit with a shunt.

Figure 6:
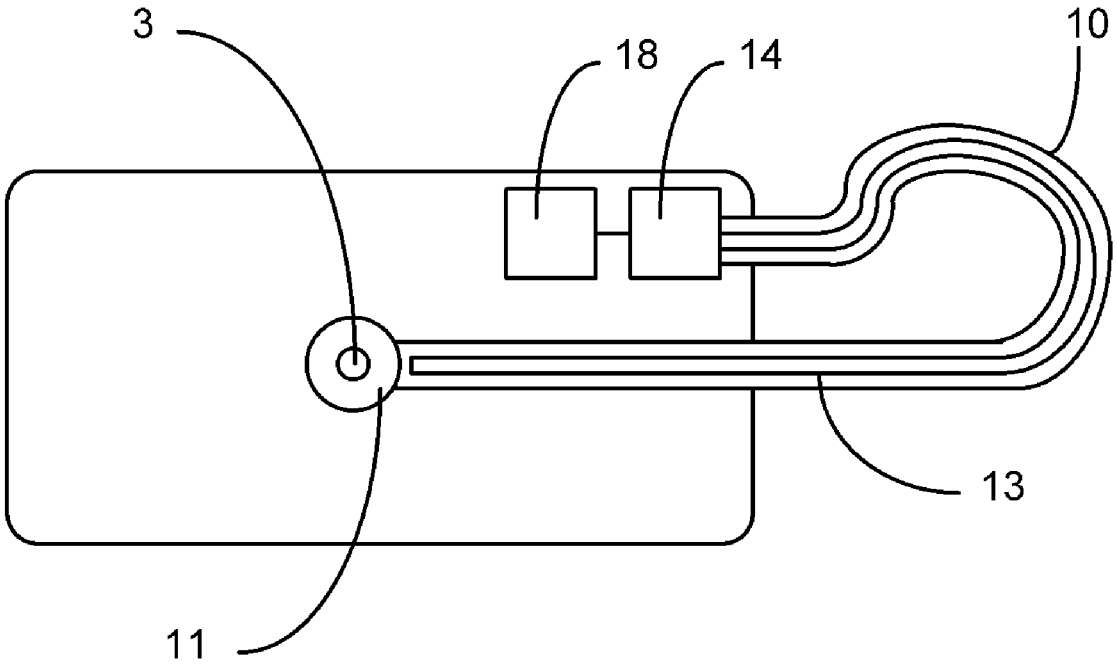
FIG. 6 is cutaway view of the lanyard attached to an audible alarm which illustrates the twin lead inside the body of the lanyard.

FIG. 6 is a diagram that illustrates the internal structure of the lanyard 10. In the preferred embodiment, the lanyard 10 has an internal wire loop 13 which extends substantially the length of lanyard 10. Internal wire loop 13 is attached to a continuity detector 14. In the event that lanyard 10 is cut by a thief for the purpose of removing the EAS tag 5 from an item, the continuity detector 14 determines that internal wire loop 13 has been severed. The continuity detector 14 then activates the thyristor circuit 18 (shown in more detail in regard to FIG. 8) in the anti-theft tag 1.

Those skilled in the art will recognize that the audible alarm 2 can be triggered by a single wire which runs from proximal end 11 to distal end 12. However, the use of a single wire to activate the audible alarm 2 can potentially be defeated by a thief who attaches a shunt from proximal end 11 to distal end 15. In this situation, the audible alarm 2 would not be triggered when lanyard 10 was severed. By using an internal wire loop 13 which extends from continuity detector 14, runs the length of, or substantially the length of, lanyard 10 and returns to continuity detector 14, an additional safety measure is provided in that the alarm cannot be defeated by a shunt. In particular, even if a shunt is used in an attempt to conceal the severing of lanyard 10, the continuity detector 14 will be activated when lanyard 10 severed. This is because the continuity detector 14 is designed to monitor the status of internal wire loop 13, not the existence of an electrical connection between the pin 3 and the continuity detector 14. For ease of illustration, the continuity detector 14 is shown as a separate component. However, those skilled in the art will recognize that continuity detector 14 can be eliminated if internal wire loop 13 is used to provide a gate signal to the audible alarm which triggers the alarm when the gate signal is interrupted by a severed lanyard 10.

Alternatively, lanyard 10 can also carry a coded signal, rather than a static voltage level. In this event, the use of a shunt to defeat lanyard 10 would also be hindered. However, a drawback to this embodiment is that the use of a coded signal would increase cost due to the need for additional circuitry, and may potentially reduce battery life.

In summary, the first embodiment activates the audible alarm 2 when the pin 3 is forcibly pulled and/or when it enters the field of the system at the merchant's exit, thus setting off the alarm. The alternative embodiment, which is based on a lanyard 10 with an internal wire loop 13 that can be used independently of the first embodiment, or in combination with the first embodiment, thereby providing an additional layer of security. A further advantage of the lanyard 10 is that can be used to protect anything that can be secured with a closed loop opening, such as purse handle, luggage handle, coat, dress, shirt, mechanical devices such as bicycles, cameras, etc. In fact, anything of value to which a closed loop such as lanyard 10 can be attached to, is suitable for use with the EAS tag 5. A unique feature of lanyard 10 is that it has an internal wire loop 13 running through it that extends from the proximal end of the audible arm 2 to the distal end of the lanyard 10 and then returns to the proximal end of lanyard 10. The distal end of the lanyard 10 has a washer 11 that secures to the pin 3 of the alarm 2. The pin 3 is then is inserted into the EAS tag 5 or any other suitable lock that secures the pin and lanyard washer 11. If the lanyard 10 is cut in order to steal the item the alarm would be activated. It should be noted that internal wire loop 13 can also be designed such that it extends from the distal end 12 of lanyard 10 to the proximal end 15 of lanyard 10.

Figure 7A:
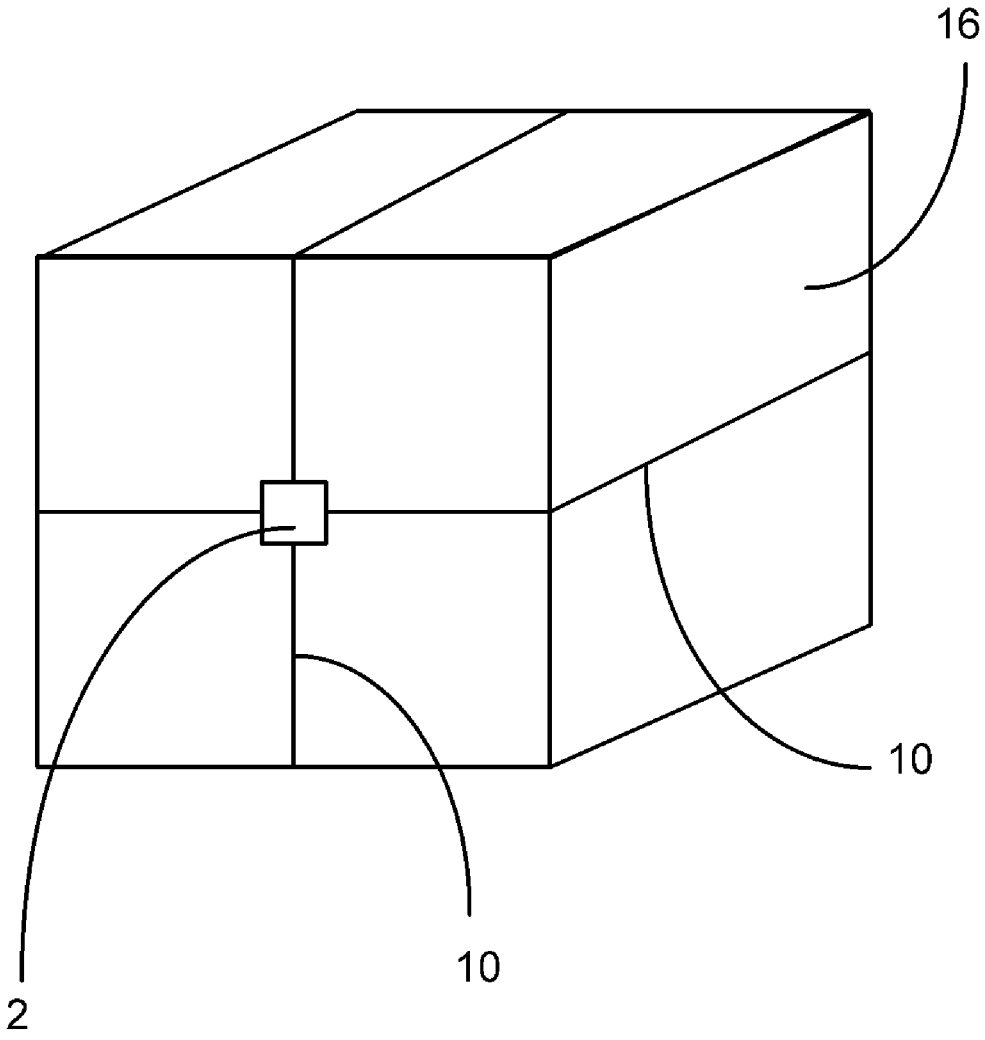
FIG. 7A is perspective view of an alternative preferred embodiment in which the audible alarm and external lanyards are attached to a large item, such as a box.

FIG. 7A is perspective view of an alternative preferred embodiment in which the audible alarm 2 and external lanyards 10 are attached to a large item, such as a box 16. In this embodiment, the audible alarm 2 and the EAS tag may preferably be combined into a single device.

Figure 8:
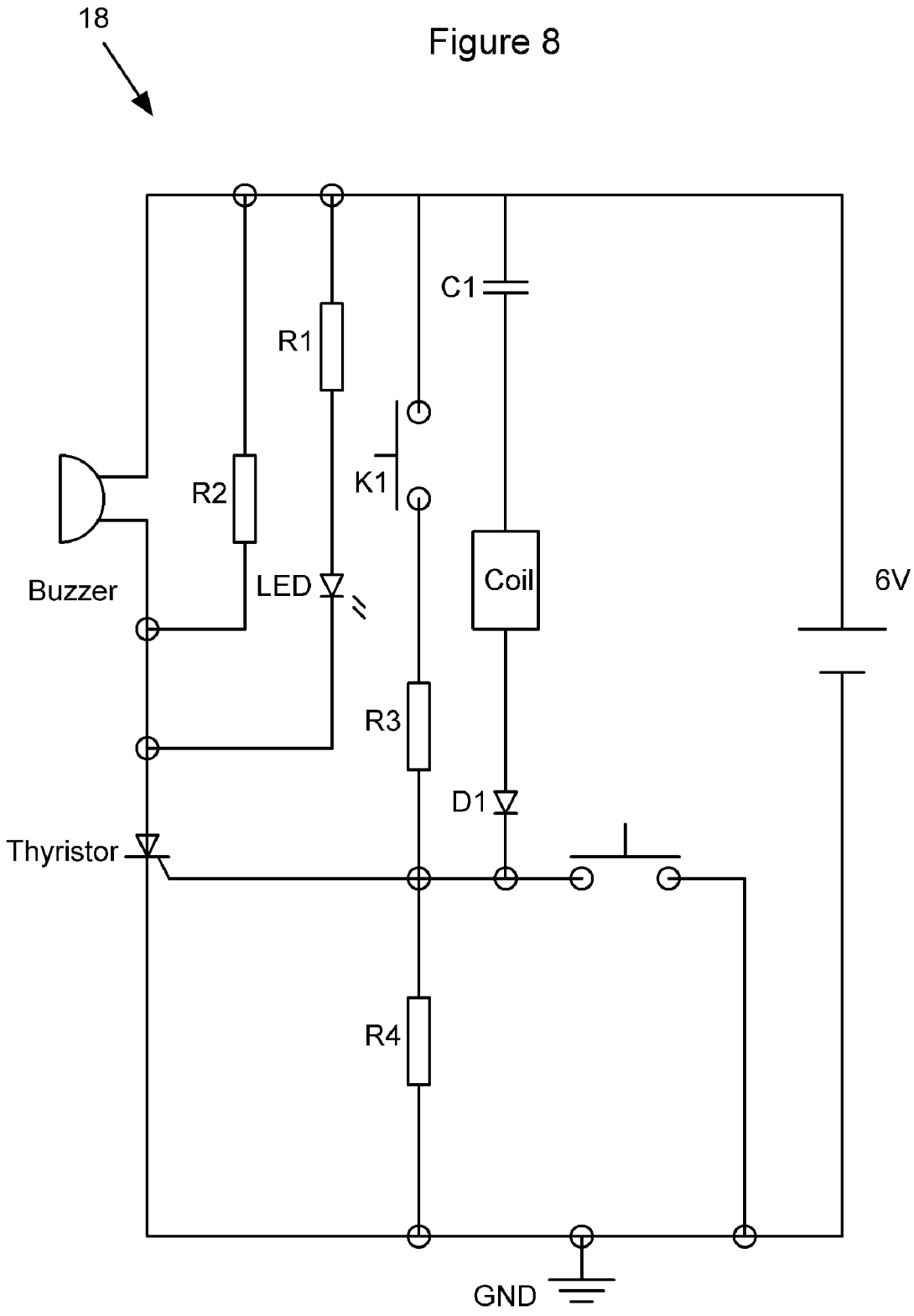
FIG. 8 is a preferred embodiment of the thyristor circuit used to trigger the audible alarm.

FIG. 8 illustrates a preferred embodiment of the thyristor circuit 18 used to activate the audible alarm 2. Thyristors (e.g. silicon controlled rectifiers, or SCR's) are well known in the art. A thyristor is similar to a transistor in that a small current flow into its gate allows a larger current to flow from its anode to its cathode. However, thyristor is different from ordinary transistors in that once activated, current will continue to flow from anode to cathode. In effect, it operates as a latch. The only way to deactivate the thyristor is to turn off all power.

In addition to the uses for the audible alarm 2 which were discussed in a previous embodiments, one or more lanyards 10 can also be used to protect boxes 16 containing large objects in a retail store, such as TVs, stereos, computers, etc. Severing of any of the lanyards 10 would activate the alarm. While the audible alarm 2 in this embodiment can be attached to an EAS tag 5 via a pin 3, as discussed in the previous embodiments, it could also be attached directly to, or embedded in, the box 16. Further, the EAS tag 5 and the audible arm 2 can be constructed as a single integral unit which is attached to the box 16 via one or more lanyards 10. In this embodiment, the audible alarm 2 activates if the lanyard 10 is forced off the box 16, if it enters the field of the system at the store exit, or if the box 16 is cut out around the audible alarm 2. In this figure, two lanyards 10 are shown extending from the audible alarm 2 and surrounding the box 16. If the lanyards 10 are severed because the audible alarm 2 was forcibly removed or an attempt was made to cut around the audible alarm 2 the audible alarm 2 would activate. During a normal sale of goods, the audible alarm 2 is either deactivated or removed from the box at the point of sales after the customer pays for the item.

Figure 7B:
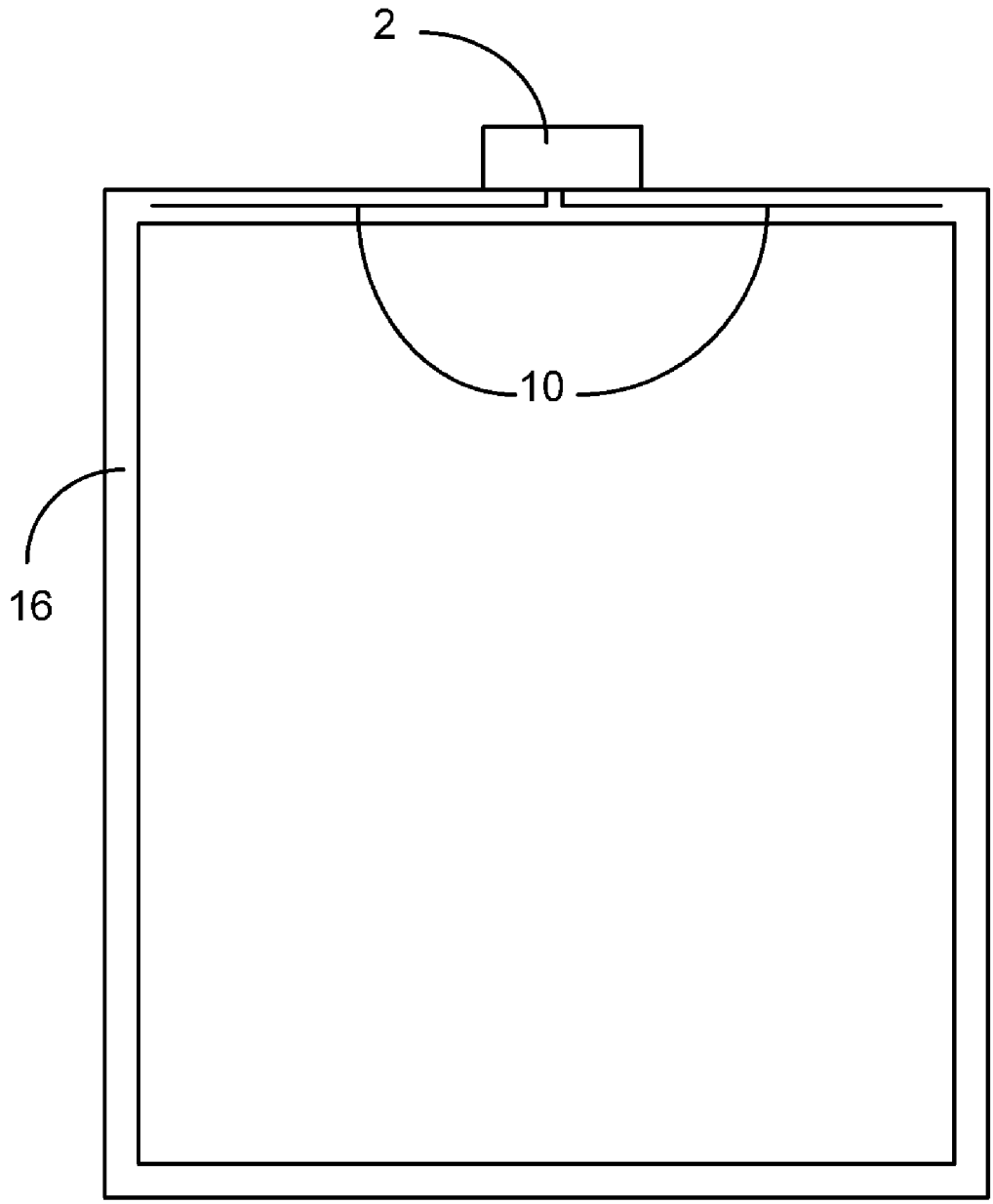
FIG. 7B is perspective view of an alternative preferred embodiment in which the audible alarm and internal lanyard wires are secured to a large item, such as a box.

FIG. 7B is perspective view of an alternative preferred embodiment in which the audible alarm 2 is used with internal lanyard 10 wires that are secured to, and/or incorporated into, the box 16. For ease of illustration, the lanyard 10 wires are shown integrated with the box 16. Alternatively, they may be secured to box 16 via an adhesive tape, etc. As was the case with the external lanyards 10, the audible alarm 2 activates when it detects that the lanyards have been severed. In addition, lanyard 10 can be concealed inside paper strips on the inside or the outside of the box 16 containing the goods. When done in this manner, the audible arm 2 will be triggered if the box 16 is cut by the thief to gain access to the goods inside.

For ease of illustration, the audible alarm 2 is shown on the surface of box 16. However, those skilled in the art will recognize that by placing audible alarm 2 inside of box 16, and embedding lanyard 10 under the surface of box 16, or concealing it as packing tape, etc., a thief will not realize audible alarm 2 is present. As a result, when the thief cuts the box 16 to access the goods inside, the audible alarm 2 will be activated.

An additional optional feature of the audible alarm 2 is that it can be automatically shut off after a determined time period. This is a battery saving feature that would stop the alarm to prevent the battery from completely draining. The time period can vary. In a preferred embodiment, a period such as one to two hours would be used for automatic shutoff. Battery life span can vary widely based on the use of the audible alarm. In particular normal battery life is 6-10 years. However, if the alarm runs without interruption, the battery life span may be no more than 10 hours.

While the invention has been described with respect to a preferred embodiment thereof, it will be understood by those skilled in the art that various changes in detail may be made therein without departing from the spirit, scope, and teaching of the invention. For example, the reset pin may be anything suitable for its purpose, the size and shape of the anti-theft tag and/or the audible alarm can vary, etc. Accordingly, the invention herein disclosed is to be limited only as specified in the following claims.

I claim:

1. An audible alarm for use with an Electronic Article Surveillance tag, comprising:

an audible alarm;

a securing pin extending from the audible alarm; and force detection means to determine when a predetermined level of force is applied to the securing pin, and means to activate the audible alarm when force is detected, the force detection means further comprises:

the securing pin extends from the audible alarm a sufficient distance to allow the pin to be detachably secured to an EAS tag;

first contact means;

second contact means secured to a first end of the securing pin;

a pliant insulator layer interposed between the first and second contact means, the pliant insulating layer having sufficient thickness to prevent the first and second contact means from coming in contact during normal use, and the pliant insulating layer further being sufficiently pliant that when a the anti-theft tag is forcibly separated from an item, the pliant insulating layer will compress such that the first and second contact means come in contact with one another; and the first and second contact means, when in contact, complete an electrical circuit which activates the audible alarm;

whereby the audible alarm will automatically be activated when the audible alarm is forcibly removed from the EAS tag.

2. An audible alarm, as in claim 1, further comprising:

a battery for supplying power to the audible alarm; and a thyristor circuit which controls the audible alarm, the thyristor circuit minimizing current drain on the battery when the audible alarm is deactivated;

whereby the thyristor circuit extends battery life by minimizing current drain while the audible alarm is not activated.

3. An audible alarm, as in claim 2, further comprising:

timing means to determine the length of time the audible alarm is activated; and means to deactivate the audible alarm time after a predetermined amount of time;

whereby battery life is extended by limiting the time period in which the audible alarm remains active.

4. An audible alarm, as in claim 2, wherein:

a reset switch operatively connected to the audible alarm such that the audible alarm is disabled when the reset switch is activated;

whereby the audible alarm can be manually reset.

5. An audible alarm, as in claim 1, further comprising:

a lanyard having a first and a second end;

the first end of the lanyard secured to, and extending from, the audible alarm;

the second end of the lanyard having means to secure to the securing pin such that when the audible alarm is attached to the EAS tag, the lanyard can be secured around or through an item;

the lanyard further having an internal wire loop which extends from the first end through substantially the length of the lanyard and then returns to the first end, or, extends from the second end through substantially the length of the lanyard and then returns to the second end;

detection means to determine when the internal wire loop is severed; and means to activate the audible alarm when the internal wire loop is severed.

6. An audible alarm, as in claim 5, wherein:

a plurality of lanyards are attached to the audible alarm;

means to activate the audible alarm if any of the lanyards are severed.

7. An audible alarm, as in claim 1, further comprising:

a lanyard having a first and a second end;

the first end of the lanyard secured to the audible alarm;

the second end of the lanyard secured to an item;

the lanyard further having an internal wire loop which extends from the first end through substantially the length of the lanyard and then returns to the first end; and detection means to determine when the internal wire loop is severed;

means to activate the audible alarm when the internal wire loop is severed.

8. An audible alarm, as in claim 7, wherein:

the lanyard is secured to packaging materials or to a box;

the lanyard is concealed such that it appears to be paper or packaging tape;

whereby if the lanyard is cut while an attempt is made to access the contents of the packaging materials or box, the audible alarm will be activated.

9. An audible alarm, as in claim 7, wherein:

the lanyard is concealed under the surface of packaging materials or under the surface of a box;

whereby if the lanyard is cut while an attempt is made to access the contents of the packaging materials or box, the audible alarm will be activated.

10. An audible anti-theft tag, comprising:

an Electronic Article Surveillance tag;

an audible alarm;

a securing pin detachably attached to the EAS tag; and force detection means to determine when a predetermined level of force is applied to the securing pin, and means to activate the audible alarm when force is detected, the force detection means further comprises:

first contact means;

second contact means secured to a first end of the securing pin;

a pliant insulator layer interposed between the first and second contact means, the pliant insulating layer having sufficient thickness to prevent the first and second contact means from coming in contact during normal use, and the pliant insulating layer further being sufficiently pliant that when a the anti-theft tag is forcibly separated from an item, the pliant insulating layer will compress such that the first and second contact means come in contact with one another; and the first and second contact means, when in contact, complete an electrical circuit which activates the audible alarm;

whereby the audible alarm will automatically be activated when the securing pin is forcibly removed from the EAS tag.

11. An audible anti-theft tag, as in claim 10, further comprising:

a battery for supplying power to the audible alarm; and a thyristor circuit which controls the audible alarm, the thyristor circuit minimizing current drain on the battery when the audible alarm is deactivated;

whereby the thyristor circuit extends battery life by minimizing current drain while the audible alarm is not activated.

12. An audible anti-theft tag, as in claim 11, further comprising:

timing means to determine the length of time the audible alarm is activated; and means to deactivate the audible alarm time after a predetermined amount of time;

whereby battery life is extended by limiting the time period in which the audible alarm remains active.

13. An audible anti-theft tag, as in claim 11, wherein:

a reset switch operatively connected to the audible alarm such that the audible alarm is disabled when the reset switch is activated;

whereby the audible alarm can be manually reset.

14. An audible anti-theft tag, as in claim 10, further comprising:

a lanyard having a first and a second end;

the first end of the lanyard secured to, and extending from, the EAS tag;

the second end of the lanyard having means to secure to the securing pin such that when the EAS tag is secured to a securing pin, the lanyard can be secured around or through an item;

the lanyard further having an internal wire loop which extends from the first end through substantially the length of the lanyard and then returns to the first end, or, extends from the second end through substantially the length of the lanyard and then returns to the second end;

detection means to determine when the internal wire loop is severed; and means to activate the audible alarm when the internal wire loop is severed.

15. An audible anti-theft tag, as in claim 14, wherein:

a plurality of lanyards are attached to the EAS tag;

means to activate the audible alarm if any of the lanyards are severed.

16. An audible anti-theft tag, as in claim 10, further comprising:

a lanyard having a first and a second end;

the first end of the lanyard secured to the audible alarm;

the second end of the lanyard secured to an item;

the lanyard further having an internal wire loop which extends from the first end through substantially the length of the lanyard and then returns to the first end; and detection means to determine when the internal wire loop is severed;

means to activate the audible alarm when the internal wire loop is severed.

17. An audible anti-theft tag, as in claim 16, wherein:

the lanyard is secured to packaging materials or to a box;

the lanyard is concealed such that it appears to be paper or packaging tape;

whereby if the lanyard is cut while an attempt is made to access the contents of the packaging materials or box, the audible alarm will be activated.

18. An audible alarm, as in claim 16, wherein:

the lanyard is concealed under the surface of packaging materials or under the surface of a box;

whereby if the lanyard is cut while an attempt is made to access the contents of the packaging materials or box, the audible alarm will be activated.

* * * * *